US008547800B2

(12) United States Patent
Kiyomizu

(10) Patent No.: US 8,547,800 B2
(45) Date of Patent: Oct. 1, 2013

(54) CLOCK DISPLAY DEVICE

(75) Inventor: Keisuke Kiyomizu, Miyazaki (JP)

(73) Assignee: Lapis Semiconductor Co., Ltd., Tokyo (JP)

( * ) Notice: Subject to any disclaimer, the term of this patent is extended or adjusted under 35 U.S.C. 154(b) by 59 days.

(21) Appl. No.: 13/361,792

(22) Filed: Jan. 30, 2012

(65) Prior Publication Data

US 2012/0230157 A1 Sep. 13, 2012

(30) Foreign Application Priority Data

Mar. 11, 2011 (JP) ..... 2011-054526

(51) Int. Cl.
*G04C 17/00* (2006.01)

(52) U.S. Cl.
USPC ..... 368/84; 368/242

(58) Field of Classification Search
USPC ..... 368/30, 82, 84, 239, 242
See application file for complete search history.

(56) References Cited

U.S. PATENT DOCUMENTS 5,585,864 A * 12/1996 Takeuchi ..... 348/719
5,703,607 A * 12/1997 Tai ..... 345/34
6,111,522 A * 8/2000 Hiltz et al. ..... 340/932.2
6,967,900 B2 * 11/2005 Chapman ..... 368/10
2004/0179109 A1 * 9/2004 Kurosawa ..... 348/222.1

FOREIGN PATENT DOCUMENTS

JP 07-120571 5/1995

* cited by examiner

*Primary Examiner* — Sean Kayes
(74) *Attorney, Agent, or Firm* — Studebaker & Brackett PC

(57) ABSTRACT

There is provided a clock display device including: a central processing unit; a liquid crystal display section; a clock information generating section; a converting section that converts the clock information into character data for display at the liquid crystal display section; a direct memory access section that fetches the character data for display without going through the central processing unit, and transfers the fetched character data for display without going through the central processing unit; a display register that stores the character data for display; a programmable display allocating section that allocates correspondences between respective bits of the character data for display that is within the display register, and respective display segments of the liquid crystal display section; and a display control section that, on the basis of results of the allocation, visibly displays the clock information at the liquid crystal display section.

6 Claims, 7 Drawing Sheets

FIG.6

| ONE-SECOND REGISTER VALUE | CHARACTER VALUES FOR 7-SEGMENT TYPE LCD | | | | | | | |
|---|---|---|---|---|---|---|---|---|
| | H | G | F | E | D | C | B | A |
| 0 | 0 | 0 | 1 | 1 | 1 | 1 | 1 | 1 |
| 1 | 0 | 0 | 0 | 0 | 0 | 1 | 1 | 0 |
| 2 | 0 | 1 | 0 | 1 | 1 | 0 | 1 | 1 |
| 3 | 0 | 1 | 0 | 0 | 1 | 1 | 1 | 1 |
| 4 | 0 | 1 | 1 | 0 | 0 | 1 | 1 | 0 |
| 5 | 0 | 1 | 1 | 0 | 1 | 1 | 0 | 1 |
| 6 | 0 | 1 | 1 | 1 | 1 | 1 | 0 | 1 |
| 7 | 0 | 0 | 1 | 0 | 0 | 1 | 1 | 1 |
| 8 | 0 | 1 | 1 | 1 | 1 | 1 | 1 | 1 |
| 9 | 0 | 1 | 1 | 0 | 1 | 1 | 1 | 1 |
| A-F | 0 | 0 | 0 | 0 | 0 | 0 | 0 | 0 |

CLOCK DISPLAY DEVICE

CROSS-REFERENCE TO RELATED APPLICATION

This application is based on and claims priority under 35 USC 119 from Japanese Patent Application No. 2011-054526 filed on Mar. 11, 2011, the disclosure of which is incorporated by reference herein.

BACKGROUND

1. Technical Field

The present invention relates to a clock display device, and in particular, to a clock display device that uses an LCD or the like and has a programmable display allocation function.

2. Related Art

LCD panels for visibly displaying various types of information are provided at portable terminals, electronic equipment and the like. Clock display is an example of the state of the display thereof. FIG. 5 shows an example of the structure of a conventional LCD clock display circuit for carrying out clock display on an LCD panel. This LCD clock display circuit is structured such that a CPU (Central Processing Unit) 101, a ROM (Read-Only Memory) 102, and a real-time clock (RTC) circuit 105 and the like transmit and receive predetermined information via a system bus 120.

In the conventional LCD clock display circuit, the real-time clock circuit 105, that is provided at a clock information generating circuit 103, generates clock information, and, at a fixed cycle, generates an interruption with respect to the CPU 101. When the CPU 101 receives an interruption request from the real-time clock circuit 105, the CPU 101 reads-out the clock information from the real-time clock circuit 105, and processes the data in order to display the information on an LCD panel 130. Then, due to the CPU 101 writing the processed data to an LCD display register 108 that structures an LCD control circuit 107, clock display on the LCD panel 130 is carried out.

On the other hand, Japanese Patent Application Laid-Open (JP-A) No. 7-120571 discloses a technique (clock counter and semiconductor integrated circuit device incorporating the clock counter therein) of transferring clock information, that is generated at a clock counter, to a display system driver section by a DMA (Direct Memory Access) section, and carrying out clock display.

When carrying out clock display by the above-described conventional LCD clock display circuit, the CPU 101 always receives an interruption request from the real-time clock circuit 105 at a fixed cycle. Therefore, at the conventional LCD clock display circuit, even in a halt mode, i.e., even when the clock supply to the CPU 101 is stopped and the CPU 101 is in a state in which operation thereof is suspended, there is the need to come out of the halt mode and transition to the usual operation mode by starting the supply of the clock. This means that the halt mode cannot be maintained because of the clock display. As a result, in a conventional LCD clock display circuit, there is the problem that a reduction in the current that is consumed (the electric power that is consumed) at the CPU cannot be devised, and wasteful consumption of electric power occurs.

Further, in the conventional LCD clock display circuit, when clock display is carried out at the LCD panel 130, the data that is transferred to the LCD display register 108 must be processed so as to conform to the LCD panel 130. If the LCD panel 130 is a 7-segment type display device for example, in a case in which the hours, minutes and seconds are managed as the clock information by 4-bit decimal numbers, the clock information within the real-time clock circuit 105 must be data processed in accordance with the conversion table shown in FIG. 6.

FIG. 7 shows an example of the data processing of the clock information. When the one-second register value is 4, only the low-order four bits of the data within the register are valid, and therefore "0100" (a decimal) is processed to "01100110" as the character value for a 7-segment type LCD. Accordingly, carrying out such processing of display data on all of the hour, the minute and the second each time display is carried out causes in the problems of complicating processing at the CPU and increasing the load on the CPU.

Processing of display data such as described above is problematic also in the device disclosed in JP-A No. 7-120571. Namely, this is because, in the device disclosed in JP-A No. 7-120571, transfer of clock information using DMA is carried out and the load on the software is reduced, but at the display system driver section that receives the clock information generated at the clock/calendar function section, there is the need to separately process, for LCD display, this clock information.

SUMMARY

The present invention is proposed in order to overcome the above-described problems, and an object thereof is to provide a clock display device that suppresses the amount of electric power that is wastefully consumed at a central processing unit at the time of clock display, and that can prevent an increase in the load on the central processing unit that accompanies clock display.

In order to achieve the above-described object, an aspect of the present invention provides a clock display device including:

- a central processing unit;
- a liquid crystal display section that can display plural digits, and at which a display portion of each digit is formed from plural display segments;
- a clock information generating section that generates clock information;
- a converting section that converts the clock information into character data for display at the liquid crystal display section;
- a direct memory access section that fetches the character data for display without going through the central processing unit, and transfers the fetched character data for display without going through the central processing unit;
- a display register that stores the character data for display, that is transferred from the direct memory access section, with a single address being given to each digit;
- a programmable display allocating section that, on the basis of allocation information that is set in advance, allocates correspondences between respective bits of the character data for display that is within the display register, and respective display segments of the liquid crystal display section; and
- a display control section that, on the basis of results of the allocation, visibly displays the clock information at the liquid crystal display section.

In accordance with the present invention, there are the effects that, at the time of clock display, clock display control that does not depend on a central processing unit is possible, and a decrease in the load on the central processing unit is possible, and the amount of electric power that is wastefully consumed at the central processing unit can be suppressed.

BRIEF DESCRIPTION OF THE DRAWINGS

Exemplary embodiments of the present invention will be described in detail based on the following figures, wherein:

FIG. 6 is a drawing showing a conversion table from one-second register values to 7-segment character values.

DETAILED DESCRIPTION

Figure 1:
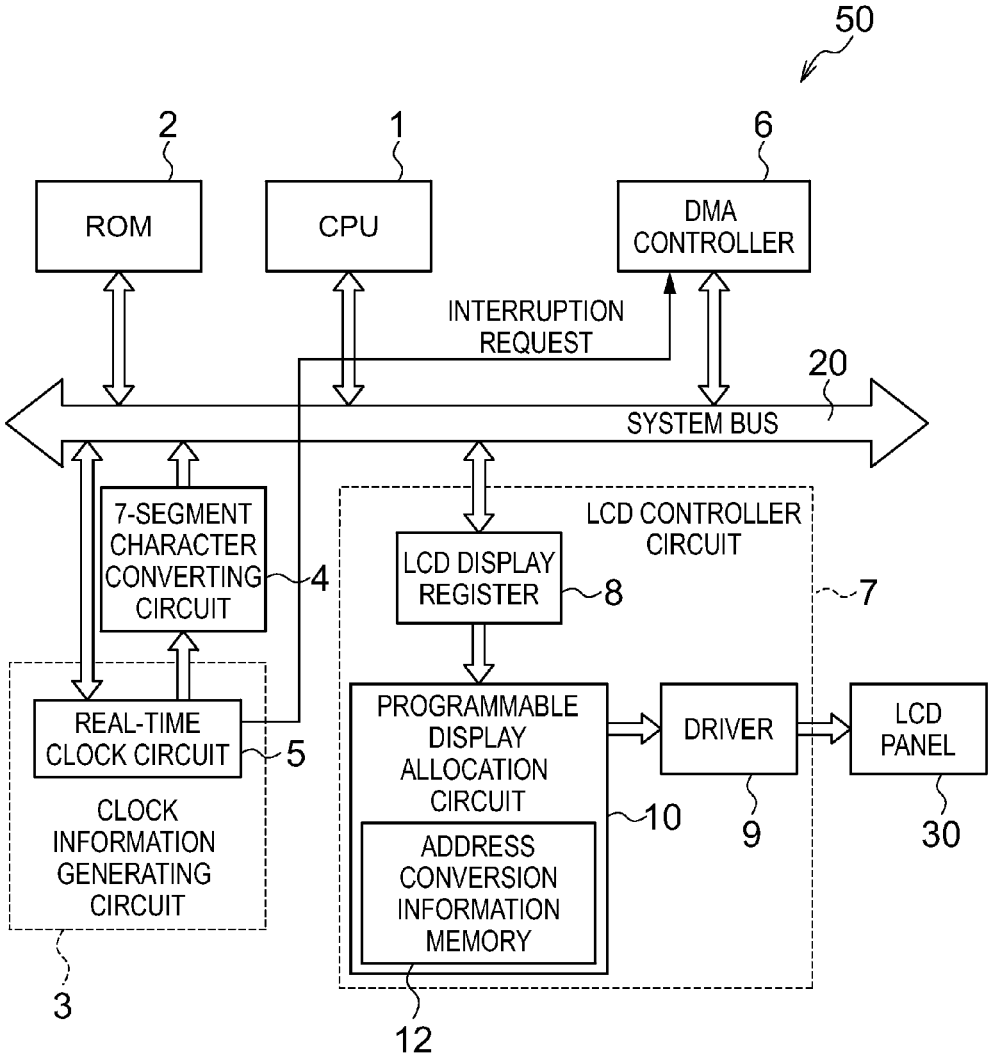
FIG. 1 is a block diagram showing the structure of an LCD clock display device relating to an exemplary embodiment of the present invention.

Preferred exemplary embodiments of the present invention are described in detail hereinafter with reference to the drawings. FIG. 1 is a block diagram showing the structure of a clock display device (also called LCD (Liquid Crystal Display) clock display device) relating to an exemplary embodiment of the present invention. As shown in FIG. 1, an LCD clock display device 50 relating to the exemplary embodiment of the present invention is structured such that a CPU (Central Processing Unit) 1, a ROM (Read-Only Memory) 2, a clock information generating circuit 3, an LCD control circuit 7 that carries out LCD display control, and the like exchange predetermined information via a system bus 20 that can transfer plural bits of data simultaneously at a predetermined operating frequency. Further, the LCD clock display device 50 has a DMA controller 6 for carrying out transfer of data through the system bus 20 without going through the CPU 1.

The LCD control circuit 7 is structured by an LCD display register 8 that is the transfer destination of the display data from the DMA controller 6, a programmable display allocation circuit 10 that has a programmable display allocation function that is described later, and a driver 9 that drives an LCD panel 30 in order to visibly display the time on the LCD panel 30 by hours, minutes and seconds, on the basis of clock information.

The CPU 1 functions as a central processing unit that governs control of the entire LCD clock display device 50. A control program of the LCD clock display device 50, and the like are stored within the ROM 2, and the CPU 1 successively reads-out and executes this program. A real-time clock circuit 5, which is provided at the clock information generating circuit 3, generates predetermined clock information, and, at a fixed cycle, generates an "interruption request" with respect to the DMA controller 6. Further, a 7-segment character converting circuit 4 converts clock information, that is a decimal number expressed by 4 bits and is generated by the real-time clock circuit 5, into an 8-bit character for a 7-segment type LCD. The data that is character-converted in this way is read by the DMA controller 6 via the system bus 20, and the DMA controller 6 transfers this data, that has been converted into characters, to the LCD display register 8. Due thereto, the clock information is updated appropriately at the LCD display register 8.

Figure 7:
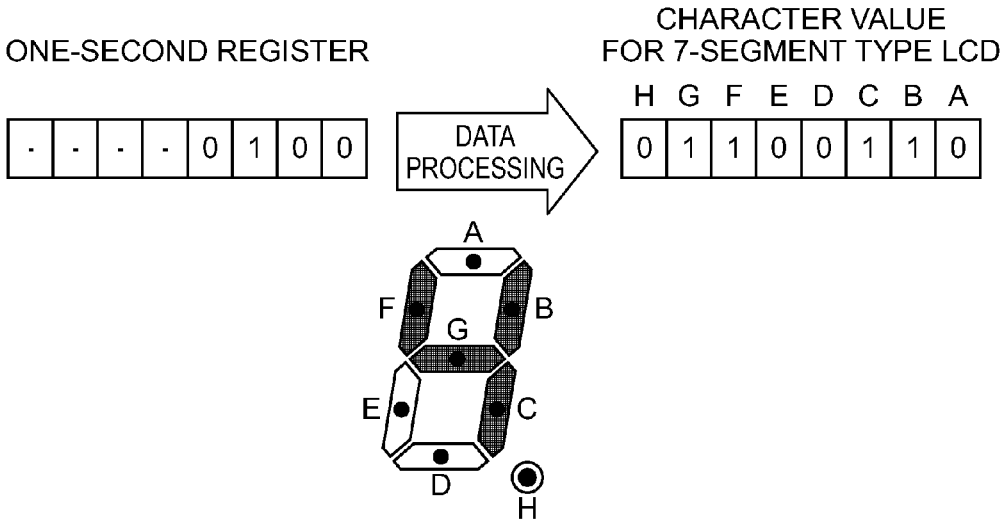
FIG. 7 is a drawing showing an example of data processing of clock information.

Note that, at the 7-segment character converting circuit 4, the method of converting the 4-bit (decimal number) clock information into an 8-bit character for a 7-segment type LCD is the same as the method shown in FIG. 6 and FIG. 7. Therefore, illustration and description thereof are omitted here.

The clock display operation at the LCD clock display device relating to the exemplary embodiment of the present invention is described next. Here, explanation is given by using, as an example, operation that visibly displays, on the LCD panel 30 and each one second, the clock information that is generated at the real-time clock circuit 5 of the LCD clock display device 50.

In order to display clock information on the LCD panel 30 per second, the clock information generating circuit 3 of the LCD clock display device 50 is set in advance such that the interruption cycle of the real-time clock circuit 5 that generates the clock information is "1 second", and so as to output this interruption to the DMA controller 6. The real-time clock circuit 5 that is set in this way outputs an interruption request to the DMA controller 6 each one second. Then, the DMA controller 6 that receives the interruption request reads-out the clock information from the real-time clock circuit 5, at each interruption. Note that the interruption cycle is not limited to the above-described example provided that it is a cycle at which the time (the second) can be displayed, each one second, in the one-second place.

The clock information that is read-out from the real-time clock circuit 5 goes through the 7-segment character converting circuit 4, and is taken-into the DMA controller 6 via the system bus 20. At this time, the 7-segment character converting circuit 4 converts the clock information that is a decimal number expressed by 4 bits into an 8-bit character for 7-segment LCD display, and therefore, the clock information after the conversion is taken-into the DMA controller 6. Thereafter, the DMA controller 6 transfers the taken-in clock information to the LCD display register 8 within the LCD control circuit 7, via the system bus 20.

Note that the transfer source (here, the clock information generating circuit 3 or the like) and the transfer destination (here, the LCD display register 8 within the LCD control circuit 7) of the data that the DMA controller 6 transfers are set in advance at the DMA controller 6.

Figure 2:
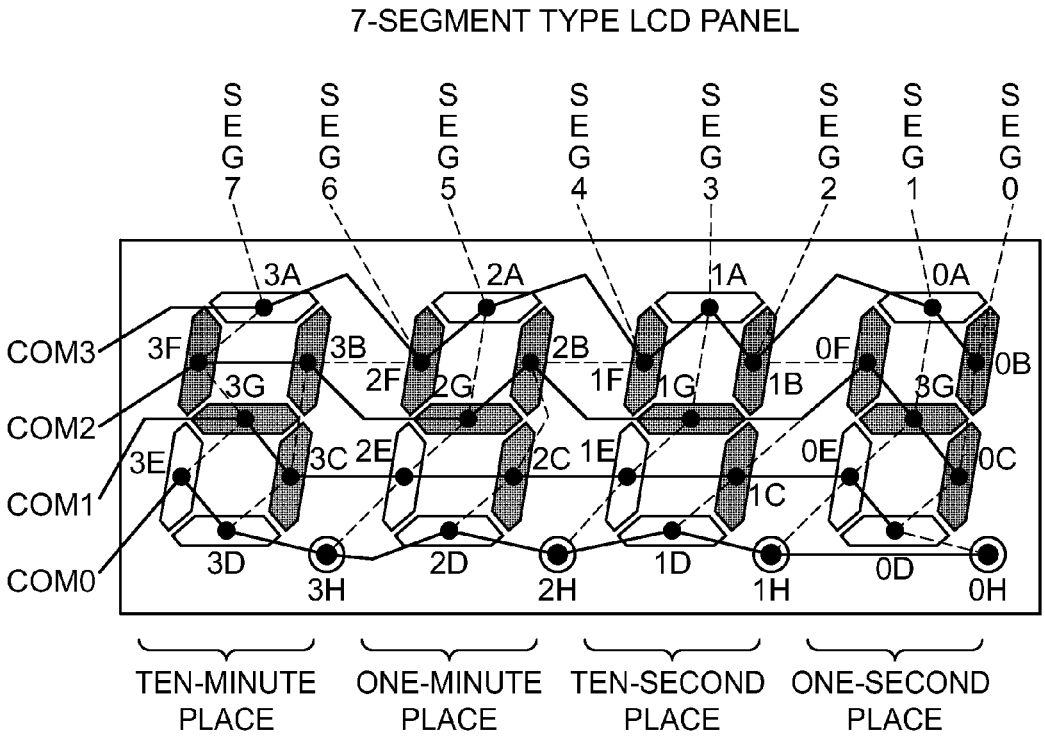
FIG. 2 is a drawing showing an example of a 7-segment type LCD panel.

FIG. 2 shows an example of a 7-segment type LCD panel. Each of the one-second place, the ten-second place, the one-minute place, and the ten-minute place has a number display portion having a 7-segment structure and a decimal point display portion having a 1-segment structure. For example, the number display portion of the one second place is formed from segments 0A through 0G, and segment 0H is the decimal point display portion. In the example shown in FIG. 2, in order to display a four-digit number on one LCD panel, segment signal input terminals (SEG0 through SEG7) having an 8-bit structure and common signal input terminals (COM0 through COM3) having a 4-bit structure are provided. Further, four common signal lines are connected to each segment signal line, and 8 segments are connected to each common signal line. Accordingly, by appropriately selecting the common signal lines and the segment signal lines, and applying a predetermined voltage to or cancelling the applied voltage to the selected signal lines, each segment that is connected to the intersection points of the selected signal lines is set in a lit or unlit state.

Figure 3:
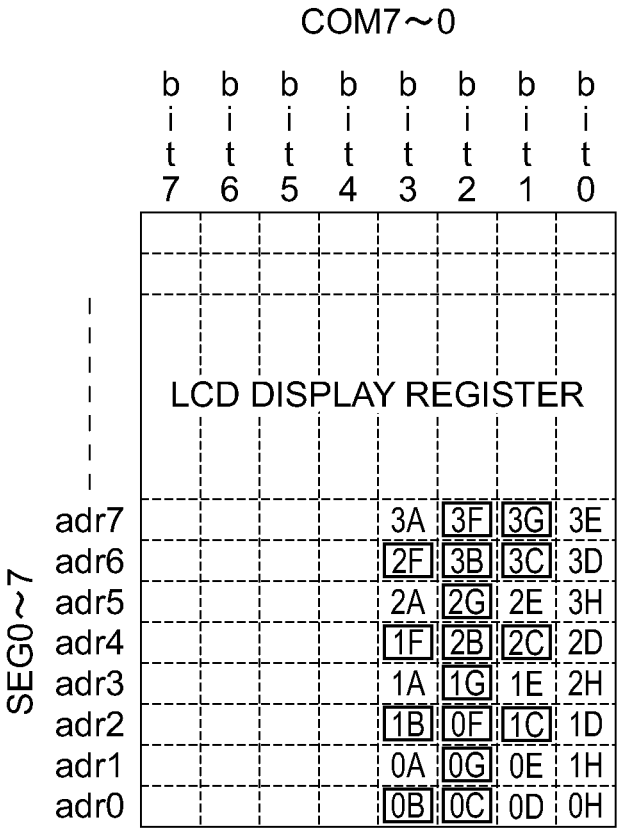
FIG. 3 is a drawing showing the data structure within an LCD display register of an LCD clock display circuit that does not have a programmable display allocation function.

FIG. 3 shows the correspondence between data (clock display data) of respective segments of a 7-segment type LCD panel, and the segment terminals and common terminals, in the LCD display register of an LCD clock display circuit that does not have a programmable display allocation function that is described later. The LCD display register shown in FIG. 3 is structured such that "bit" corresponds to a common signal line (COM) and "adr" corresponds to a segment signal line (SEG). Therefore, for example, in order to display a value (here, "4") in the one-second place for example, the segments "0B", "0C", "0F", "0G" of the LCD panel shown in FIG. 2 must be lit. In this case, the relationships between the segments, and the segment terminals (SEG) and the common terminals (COM), are "0B": SEG0-COM3, "0C": SEG0-COM2, "0F": SEG2-COM2, "0G": SEG1-COM2.

In the example shown in FIG. 3, in order to display the number "4" in the one-second place, clock data is written-in to three addresses (adr0, adr1, adr2) of the LCD display register, and further, data must be read-out from these three addresses. In addition, there are also addresses (adr1, adr2) at which clock data of the ten-second place exists together with clock data of the one-second place. Namely, in a case in which there is no programmable display allocation function, when displaying the number "4", at least three addresses of the LCD display register must be accessed.

The DMA controller merely has the function (a data transferring function) of inputting and outputting a designated address range to a designated memory, without going through a processor such as a CPU or the like. Therefore, in the data transfer by the DMA controller, the address of the transfer source, the address of the transfer destination, and the bit order of the transfer data, that are needed for this data transfer, must be the same format. As a result, a DMA controller, that does not carry out rearranging or the like of the data and has only the function of transferring data to a predetermined, set address, cannot be used with respect to an LCD display register that has a structure in which it is necessary to write the individual clock data corresponding to the respective numbers (respective places) to plural addresses as shown in FIG. 3.

Figure 4:
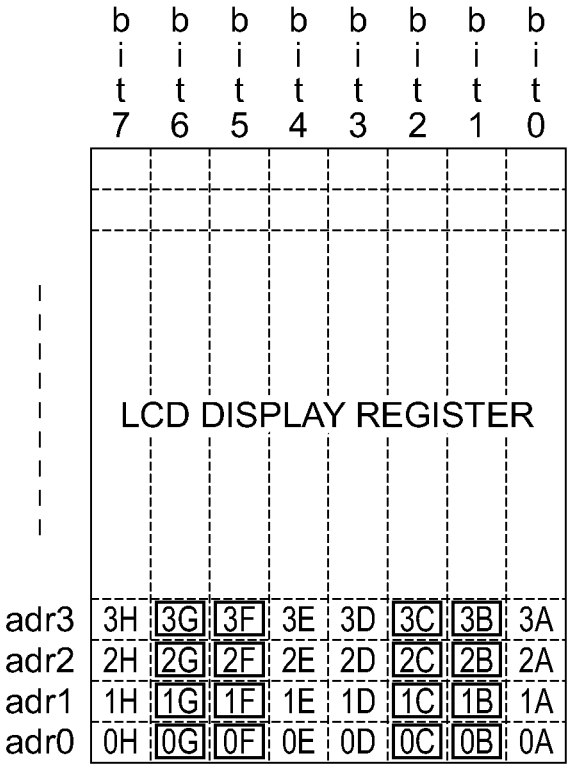
FIG. 4 is a drawing showing the data structure within an LCD display register of an LCD clock display device that has a programmable display allocation function.
Figure 5:
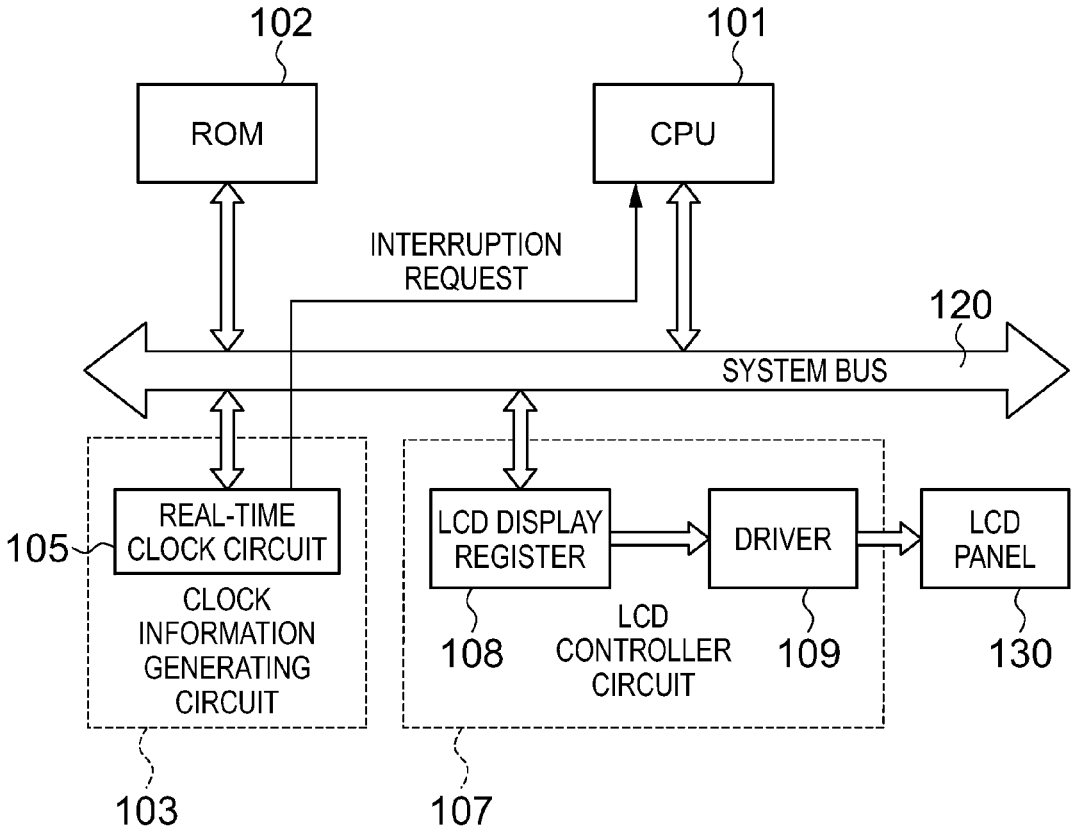
FIG. 5 is a block diagram showing an example of the structure of a conventional LCD clock display circuit.

Thus, in the LCD clock display device 50 relating to the present exemplary embodiment, as shown in FIG. 4, all of the clock data of one digit is stored in the LCD display register 8 in correspondence with one address. More concretely, because the clock data that is stored in the DMA controller 6 is transferred to the LCD display register 8 in that format as is, the LCD display register 8 is structured such that all of the data of the one-second place is stored in adr0 of the LCD display register 8, all of the data of the ten-second place is stored in adr1, all of the data of the one-minute place is stored in adr2, and all of the data of the ten-minute place is stored in adr3. Further, at the time of storing all of the data of the one-second place in one address, e.g., adr0, the segments 0A through 0H of the 7-segment type LCD panel 30 are allocated to bit0 through bit7, respectively. The same holds for the other places, such as the ten-second place and the like.

By utilizing such a structure, the clock data of the digit that is the object can be acquired collectively merely by accessing one address of the LCD display register. In the example shown in FIG. 4, by accessing the address adr0, the bit information (character value for LCD) "01100110" (corresponding to segments 0H, 0G . . . 0A of the LCD panel 30 in order from the left) for display data "4" of the one-second place can be acquired. Similarly, bit information for display data "4" of the ten-second place is obtained by accessing the address adr1, bit information for display data "4" of the one-minute place is obtained by accessing the address adr2, and bit information for display data "4" of the ten-minute place is obtained by accessing the address adr3.

In the LCD clock display device 50 relating to the present exemplary embodiment, the programmable display allocation circuit 10 that has a programmable display allocation function is positioned between the LCD display register 8 and the 7-segment type LCD panel 30 that visibly displays the hour, minute and second, and has the function of freely allocating the "bit" and "adr" of the LCD display register 8 shown in FIG. 4 to arbitrary COM terminals and SEG terminals of the 7-segment type LCD panel 30 shown in FIG. 2. Further, as shown in FIG. 1, the programmable display allocation circuit 10 incorporates therein an address conversion information memory 12 that stores information (allocation information) for converting addresses by the programmable display allocation function.

The programmable display allocation function is a function that can, by software or the like, arbitrarily allocate the correspondence between respective bits (whose bit values express the lit/unlit state) of the LCD display register and display positions (the respective display segments) on the LCD panel. As disclosed in JP-A No. 5-216427 (Japanese Patent No. 3188280) for example, the programmable display allocation circuit 10 is structured so as to store, in a display position definition storing area, allocation information that can be arbitrarily set and changed by input from the exterior or the like and that is for designating display data within the display memory, and so as to convert the display data designated by this allocation information into bit strings by a bit selector, and so as to successively transfer these bit strings in parallel to the LCD side via a shift register. Accordingly, here, illustration and explanation of the structure and the like, for realizing the programmable display allocation function at the programmable display allocation circuit 10, are omitted.

In a conventional LCD clock display circuit that does not have a programmable display allocation function (also called fixed display allocation), as shown in FIG. 3 for example, adr0-bit0 of the LCD display register is fixedly made to correspond to SEG0-COM0. However, in the LCD clock display device 50 relating to the present exemplary embodiment, adr0-bit0 of the LCD display register 8 is changed (allocated) to SEG1-COM3 as shown in FIG. 4, by using the programmable display allocation function. Therefore, "0A" is displayed at adr0-bit0 of the LCD display register 8 of FIG. 4, and the bit designated by adr0-bit0 is made to correspond to segment "0A" of a 7-segment type LCD panel.

In the LCD clock display device relating to the present exemplary embodiment, a user can, via an unillustrated signal terminal or the like, carry out arbitrary allocating with respect to the address conversion information memory 12 within the programmable display allocation circuit 10, by inputting information for display allocation or by changing allocation information that has already been inputted. For example, when the bit value "1" is to be written to the bit designated at adr0-bit0 of the LCD display register 8, the programmable display allocation circuit 10 refers to the address conversion information memory 12, and reads-out information expressing which SEG/COM the adr0-bit0 is to be allocated to. If adr0-bit0 is to be allocated to SEG1-COM3, the programmable display allocation circuit 10 sends control signals to the SEG/COM terminals of the LCD panel 30 via the driver 9, so that the segment "0A" of the 7-segment type LCD panel 30 is lit.

In the example shown in FIG. 2 and FIG. 4, when "4" is displayed in the one-second place of the 7-segment type LCD panel 30, as described above, the segments "0B", "0C", "0F", "0G" of the LCD panel 30 must be lit. Therefore, on the basis of the contents of the LCD display register 8, the programmable display allocation circuit 10 refers to the contents of the address conversion information memory 12, in which information (allocation information) for predetermined address conversion is stored, with respect to the relationships of correspondence between the respective segments of the LCD panel 30 and the segment terminals/common terminals, and allocates adr0-bit1 to SEG0-COM3, and allocates adr0-bit2 to SEG0-COM2, and allocates adr0-bit5 to SEG2-COM2, and allocates adr0-bit6 to SEG1-COM2. Then, in accordance with these allocations, control signals (e.g., alternating current square-wave signals) are applied to the SEG/COM terminals of the LCD panel 30. As a result, the segments "0B", "0C", "0F", "0G" of the one-second place of the LCD panel 30 are lit, and "4" is displayed at the one-second place of the LCD panel 30. Similar control is carried out for the other places as well, such as the 10-second place and the like.

As described above, the LCD clock display device relating to the present exemplary embodiment is structured such that, without going through a CPU, clock data is read from the clock information generating circuit, and this clock data is transferred to the LCD display register without going through a CPU. Due thereto, complication of processing, that accompanies display data processing and the like at the CPU at the time of carrying out clock display, is avoided, and the load on the CPU in the clock display processing can be reduced. Further, by providing the 7-segment character converting circuit 4, there is no need for the CPU to data-process the 4-bit clock information into an 8-bit character for a 7-segment type LCD, for the hour, minute and second display data each time display is carried out, as is the case conventionally. Therefore, complicating of the processing at the CPU and an increase in the load can be avoided.

Further, by carrying out clock data transfer without going through the CPU, even when the CPU is in a halt mode, there is no need to cancel the halt mode for the clock display processing, and the halt mode is maintained as is. Due thereto, there are the effects that a reduction in the electric power that is consumed at the CPU can be aimed for, and wasteful electric power consumption that accompanies clock display processing does not arise.

Moreover, by employing the programmable display allocation function, the clock data per display digit can be acquired collectively merely by accessing a single address of the LCD display register, and further, the allocating of the respective bits of the LCD display register and the respective display segments on the 7-segment type LCD panel can be carried out arbitrarily by software or the like. Accordingly, in the LCD clock display device relating to the present exemplary embodiment, the transfer of clock data, that conforms with character data for display, between memories within the LCD clock display device is possible by using a DMA controller that has only the function of transferring data to a set address and that could not be employed in a conventional LCD clock display circuit.

Note that, in the above-described exemplary embodiment, an example is given of a structure in which, even at the time of the clock display processing, the halt mode of the CPU is maintained, and the amount of current that is consumed at the CPU is reduced. However, the present invention is not limited to the same. For example, there may be a structure in which the processing capability (performance) of the system overall is improved by, at the time of the clock display processing, causing the CPU to carry out a processing other than the clock display processing.

What is claimed is:

1. A clock display device comprising:

a central processing unit;

a liquid crystal display section that can display a plurality of digits, and at which a display portion of each digit is formed from a plurality of display segments;

a clock information generating section that generates clock information;

a converting section that converts the clock information into character data for display at the liquid crystal display section;

a direct memory access section that fetches the character data for display without going through the central processing unit, and transfers the fetched character data for display without going through the central processing unit;

a display register that stores the character data for display, that is transferred from the direct memory access section, with a single address being given to each digit;

a programmable display allocating section that, on the basis of allocation information that is set in advance, allocates correspondences between respective bits of the character data for display that is within the display register, and respective display segments of the liquid crystal display section; and a display control section that, on the basis of results of the allocation, visibly displays the clock information at the liquid crystal display section.

2. The clock display device of claim 1, wherein the direct memory access section receives an interruption request from the clock information generating section, and carries out fetching and transfer of the character data for display.

3. The clock display device of claim 1, wherein the display segments are positioned at intersection points of segment signal lines and common signal lines that are disposed at the liquid crystal display section, and the programmable display allocating section carries out allocation with respect to correspondences between respective bits of the character data for display that is stored in the display register, and the segment signal lines and common signal lines.

4. The clock display device of claim 3, wherein the allocation information is rewritable.

5. The clock display device of claim 3, wherein, on the basis of bit values of the respective bits of the character data for display, the display control section inputs predetermined control signals to the allocated segment signal lines and common signal lines, and sets the display segments in lit states or unlit states.

6. The clock display device of claim 5, wherein the display control section visibly displays at least a second, a minute, and an hour in correspondence with the respective digits.

* * * * *